United States Patent [19]

Jentsch

[11] Patent Number: 4,545,149

[45] Date of Patent: Oct. 8, 1985

[54] DEVICE FOR SECURING THE LOCKED POSITION OF A MOTOR-VEHICLE DOOR

[75] Inventor: Wolfgang Jentsch, Niestetal-Heiligenrode, Fed. Rep. of Germany

[73] Assignee: Gebr. Bode & Co. GmbH, Kassel, Fed. Rep. of Germany

[21] Appl. No.: 567,474

[22] Filed: Jan. 3, 1984

[51] Int. Cl.[4] ..... E05F 7/02

[52] U.S. Cl. ..... 49/255; 49/280; 49/334; 49/394

[58] Field of Search ..... 49/280, 255, 253, 334, 49/394

[56] References Cited

U.S. PATENT DOCUMENTS

| | | | |
|---|---|---|---|
| 4,087,939 | 5/1978 | Elguindy et al. | 49/280 X |
| 4,282,686 | 8/1981 | Brirzke et al. | 49/334 X |
| 4,308,691 | 1/1982 | Horn | 49/255 |

FOREIGN PATENT DOCUMENTS

| | | | |
|---|---|---|---|
| 1961573 | 7/1971 | Fed. Rep. of Germany | 49/255 |
| 2062135 | 7/1972 | Fed. Rep. of Germany | 49/255 |
| 2014231 | 8/1979 | United Kingdom | 49/255 |

*Primary Examiner*—Philip C. Kannan

*Attorney, Agent, or Firm*—Sprung, Horn, Kramer & Woods

[57] ABSTRACT

A device for securing the locked position of a motor-vehicle door activated by a rotating post and that is locked or unlocked by raising and lowering the post has a disk attached to the post and a rotating support in the form of a double-armed lever mounted below the disk on a stationary section of the frame so that the support can be displaced into a position in which the disk rests on the top of one of the lever arms. The axis of rotation of the support is positioned on the frame section and lies in a plane that is perpendicular to the direction in which the rotating post is raised and lowered. The bottom of the second lever arm of the support rests on and is forced by a compression spring against a stop on the frame section and the bottom of the first arm of the support has a recess. A rotating locking element, which is also a double-armed lever with two support surfaces on one arm, engages the recess. The axis of rotation of the support, which is positioned on the frame section, parallels the axis of rotation of the support and the support surfaces are adjacent and essentially perpendicular to each other, with one extending essentially radially to the axis of rotation of the locking element and the other essentially tangential to the direction in which the locking element rotates. The recess in the support has two adjacent and perpendicular contact surfaces against which the support surfaces of the locking element rest in the locking state, and the second lever arm of the locking element is connected to at least one activating mechanism.

5 Claims, 5 Drawing Figures

Fig. 4
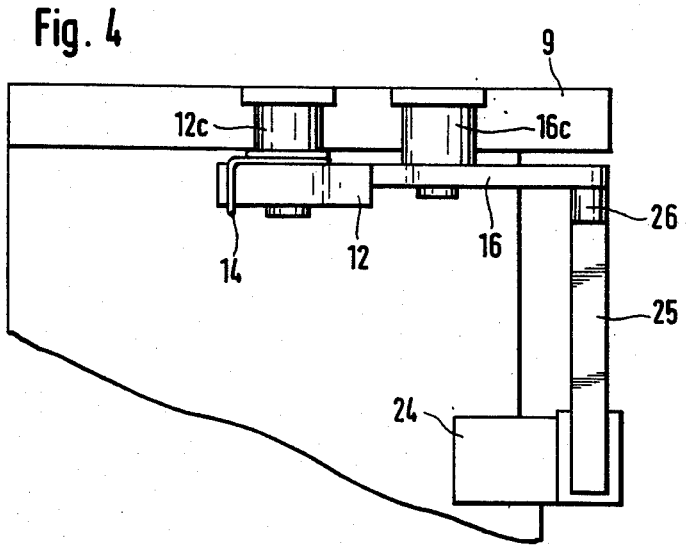
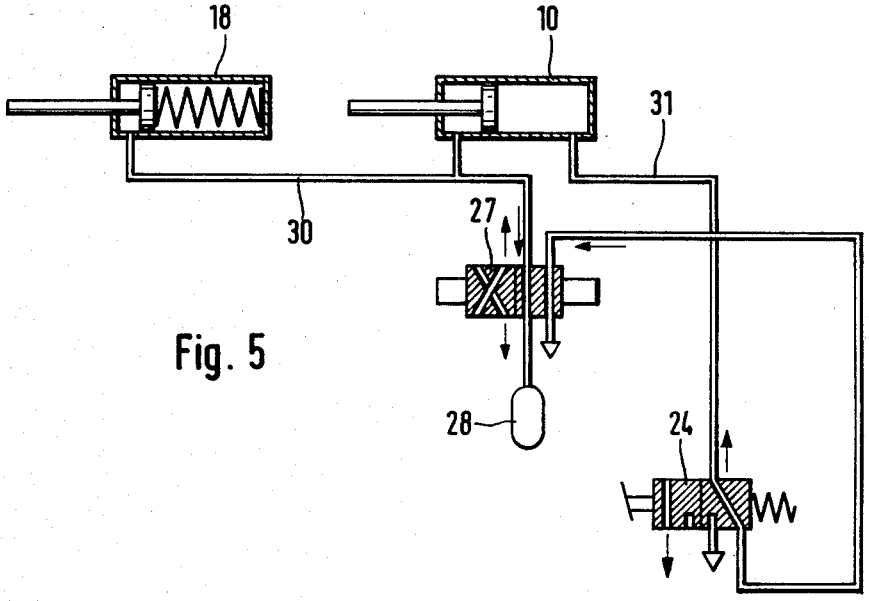
Fig. 5

DEVICE FOR SECURING THE LOCKED POSITION OF A MOTOR-VEHICLE DOOR

BACKGROUND OF THE INVENTION

The present invention relates to a device for securing the locked position of a motor-vehicle door, especially an outward-swinging door, activated by a post that rotates.

Motor-vehicle doors activated by a rotating post are frequently employed in public transportation in buses, trolleys, and trains. The door is connected to the rotating post by swinging arms and the post can be rotated outwards, with an intermediate screw transmission for example, by a piston-and-cylinder drive mechanism to open and close the door. A mechanism for activating a door of this type is described for example in German Pat. No. 1 961 573.

Positioning a locking device on doors of this type to keep them closed is also known. A locking device of this type is described for example in German Pat. No. 2 062 135. The rotating post in this known device can be rotated axially along with the door panel into the closed position, with locking components on the stationary frame of the door engaging others on the panel.

Since the piston-and-cylinder drive mechanisms of doors of this type are generally operated with compressed air, there is a drawback to the aforesaid known device in that the weight of the door forces the door panel and rotating post to drop when the compressed air fails, releasing the locking device. Unintended unlocking of the door can of course lead to accidents when, for example passengers lean against it from inside.

A device for securing the locked position of a vehicle door activated by a rotating post has accordingly also become known. In this device the door is locked or unlocked by raising and lowering the post and a disk is attached to the post. A rotating support in the form of a double-armed lever is mounted below the disk on a stationary section of the frame. The support can be displaced into a position in which the disk rests on the top of one of the lever arms. A device of this type is described in German Pat. No. 2 805 639 for instance.

The axis on which the support rotates in this known device essentially parallels the longitudinal axis of the rotating post. To release the door, the support is rotated in a plane perpendicular to the length of the post until the disk is released and the post can drop into the unlocking position. To ensure that the door can be opened in an emergency there is a manually operated tension cable that engages the support and can be employed to rotate it into a position in which it is no longer below the disk. Since the weight of the door as a whole rests on the support, it can at times be difficult to displace the support by hand. For this reason, a roller has already been positioned on the support in the known device to facilitate moving the support below the disk.

It turns out that the support in the known device can only be displaced by applying a powerful force, causing problems with respect to unlocking the door in an emergency, which can provoke panic among the passengers under certain conditions.

SUMMARY OF THE INVENTION

The main object of the present invention is to eliminate the aforesaid drawback by improving the known device to the extent that the amount of force that has to be applied to displace the support into the unlocking position can be considerably decreased.

This object is achieved in accordance with the present invention wherein the axis of rotation of the support, which is positioned on the frame section, lies in a plane that is perpendicular to the direction in which the rotating post is raised and lowered. The bottom of the second lever arm of the support rests on and is forced by a compression spring against a stop on the frame section. The bottom of the first arm of the support has a recess. A rotating locking element, which is also a double-armed lever with two support surfaces on one arm, engages the recess. The axis of rotation of the support, which is positioned on the frame section, parallels the axis of rotation of the support. The support surfaces are adjacent and essentially perpendicular to each other, with one extending essentially radially to the axis of rotation of the locking element and the other essentially tangential to the direction in which the locking element rotates. The recess in the support has two adjacent and perpendicular contact surfaces against which the support surfaces of the locking element rest in the locking state.

The second lever arm of the locking element is connected to at least one activating mechanism.

The particular position of the support surfaces on the locking element and of the contact surfaces on the support allows the device to be unlocked with very little force.

The function can be improved even more if the second support surface is curved in the shape of an arc of a circle with the axis of rotation of the locking element as the center of curvature so that the support is not displaced when the locking element is rotated until release ensues.

To allow the door to be unlocked either by the compressed air mechanism or, in emergencies, by hand, it is very practical for the second lever arm of the locking element to be connected to a compressed-air activated piston-and-cylinder drive mechanism and to a manually activated Bowden cable for unlocking the device.

An opposing stop, adjustable in height, positioned on the bottom of the second lever arm of the support and operating in conjunction with the stop positioned on the frame section is practical for precise adjustment of the device.

It is also practical for the piston-and-cylinder drive mechanism that carries out the unlocking to communicate along with a compressed-air cylinder that opens and closes the door through a control valve with a source of compressed air and for the Bowden cable to activate an air-evacuation valve for the compressed-air cylinder.

One embodiment of the invention will now be described with reference to the attached drawings, wherein

BRIEF DESCRIPTION OF THE DRAWINGS

FIG. 4 is a detail of the view in FIG. 2, and FIG. 5 is a schematic diagram of a compressed-air system for activating a vehicle door with a device of the type illustrated in FIGS. 1 through 4.

DETAILED DESCRIPTION OF THE INVENTION

Figure 1:
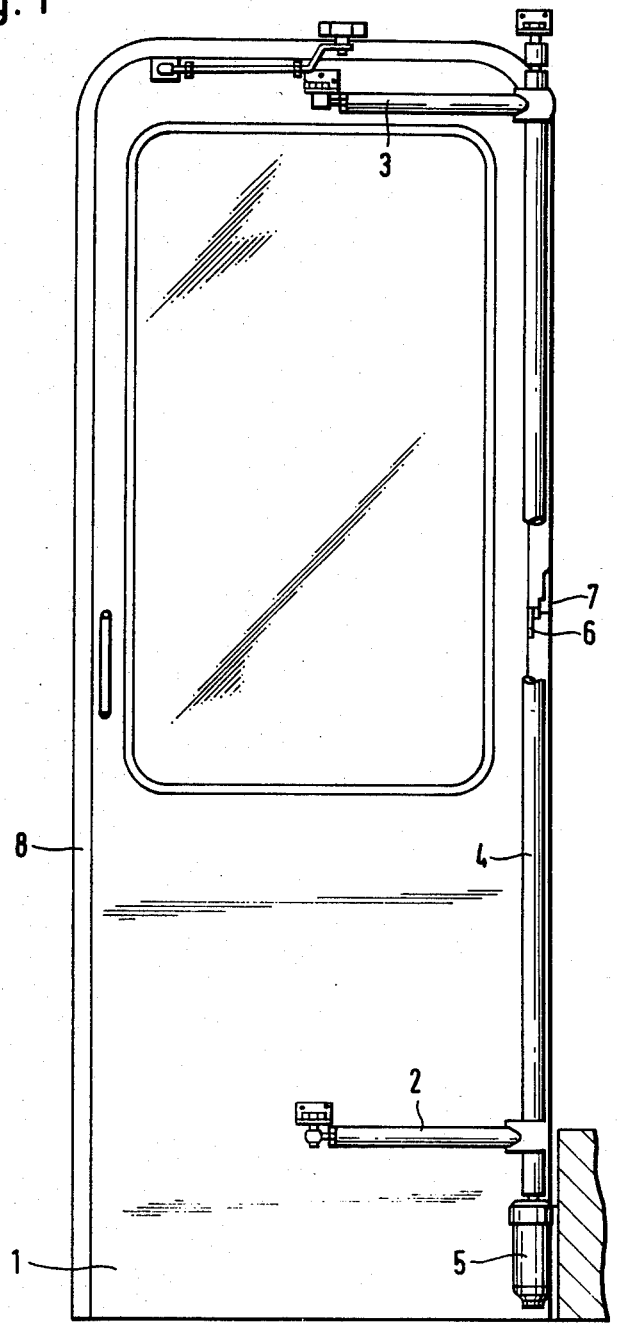
FIG. 1 is a front view, from THE inside of a vehicle, of a door attached to a rotating post and with a device in accordance with the invention for securing the locked position of the door.

The panel 1 of a door, part of which is illustrated in FIG. 1 as seen from the inside of a vehicle, a bus for instance, is mounted in a door frame 8 and swung by swinging arms 2 and 3. Swinging arms 2 and 3 are articulated on one end to panel 1 and on the other to a post 4, which rotates. Post 4 is rotated by an interior screw transmission that is in itself known and is not illustrated, see for example German Pat. Nos. 1 961 573 and 2 062 135.

The screw transmission is powered by a compressed-air cylinder 10 (FIG. 2) inside a housing 5 at the bottom of rotating post 4. A device, which will be described in greater detail, is provided for securing the locked position of the door and is also accommodated in housing 5.

The closed door is locked with special locking components, one, 6, on panel 1 and the other, 7, on door frame 8. Locking components 6 and 7 may consist of wedge-shaped catches as is shown for example in German Pat. No. 2 062 135.

When the compressed-air drive mechanism in housing 5 activates the screw transmission inside rotating post 4, the post executes a rotation in conjunction with swinging arms 2 and 3, moving the door. Although the screw transmission is blocked at the end of the closing process when the door is closed, the pressure of the compressed-air drive mechanism continues in force, lifting rotating post 4 and engaging locking component 6 with locking component 7. If the supply of compressed air were interrupted, no more pressure would be applied to the compressed-air drive mechanism either and rotating post 4 would drop, releasing locking components 6 and 7 from each other. The device for securing the locked position of the door and located at the bottom of rotating post 4 and inside housing 5, is intended to prevent this and will now be described.

Figure 2:
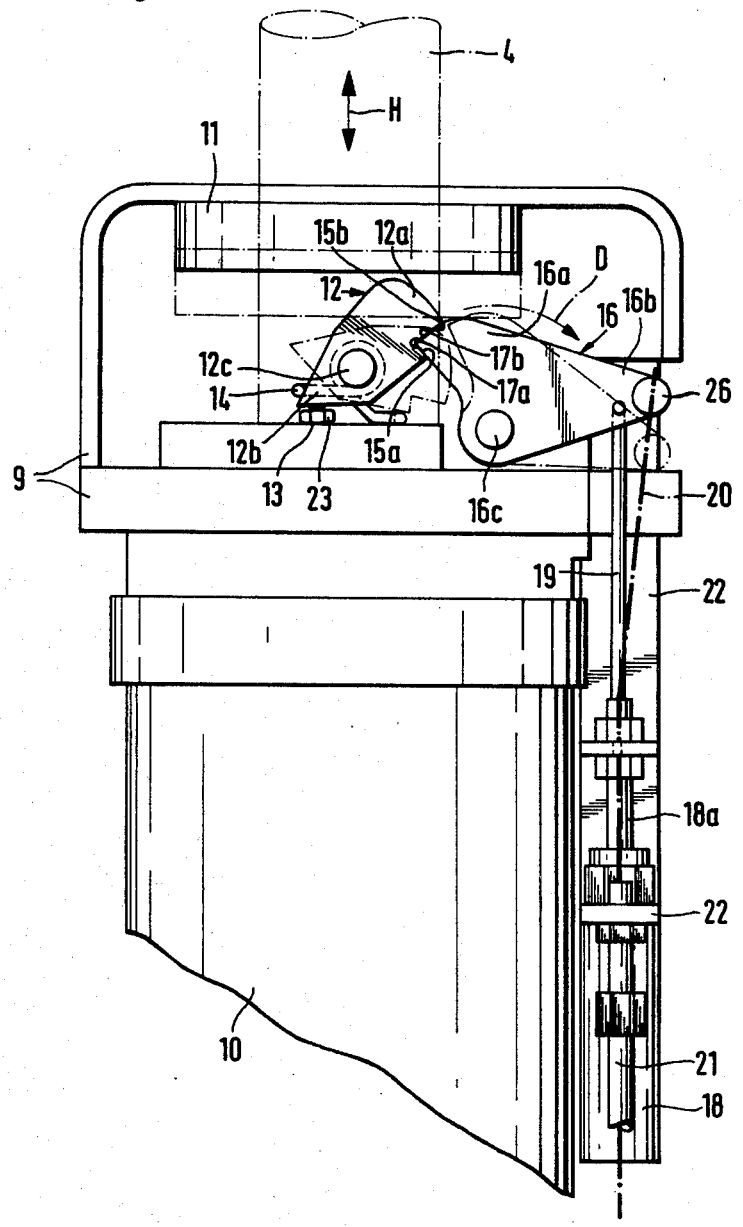
FIG. 2 is an enlarged detail of a side view of the device illustrated in FIG. 1.
Figure 3:
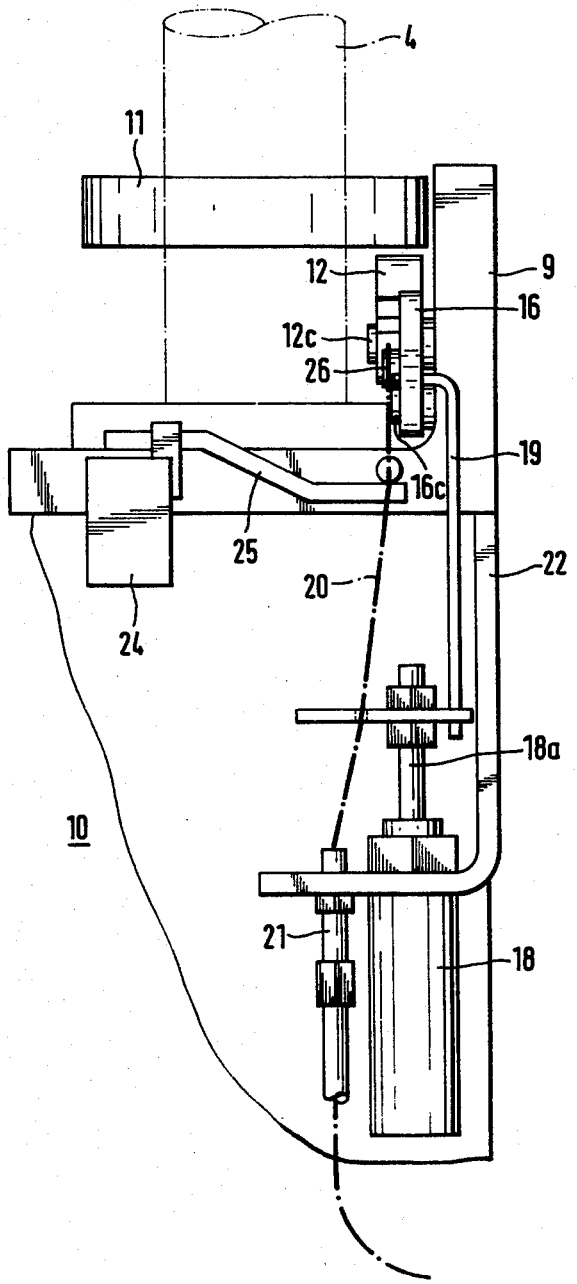
FIG. 3 is a view of the same device rotated 90° from FIG. 2.

As will be evident from FIGS. 2 through 4, there is a mount in the form of a disk 11 at the bottom of rotating post 4. Below disk 11 is a support 12 that pivots around an axis of rotation 12*c* on a section 9 of door frame 8. Support 12 is a lever with two arms 12*a* and 12*b*. The bottom of disk 11 can rest on the top of lever arm 12*a* when support 12 is in the locking position represented by the solid line in FIG. 2. In this locking position the bottom of the other lever arm 12*b* of support 12 rests against a stop 13 on frame section 9. There is an adjustable opposing stop in the form of a screw 23 on the bottom of second lever arm 12*b*. Screw 23 allows the locking position of support 12 to be precisely established.

As will be evident from the drawings, the axis 12*c* of rotation of support 12 is in a plane perpendicular to the longitudinal axis of the device and hence perpendicular to the direction H in which rotating post 4 is raised and lowered. Support 12 is forced against stop 13 and maintained upright by a compression spring 14.

There is a recess on the bottom of support 12 consisting of two contact surfaces 15*a* and 15*b* that are adjacent to and substantially perpendicular to each other. One contact surface 15*a* merges into the bottom of support 12 and the other 15*b* into a lateral support that slants upward in the erect position.

A locking element 16 can engage the recess including 15*a* and 15*b* in support 12. Locking element 16 rotates around an axis 16*c* on frame section 9. Axis 16*c* is somewhat below and parallel to axis of rotation 12*c*. Locking element 16 is also a lever with two lever arms 16*a* and 16*b*. Lever arm 16*a* has two supporting surfaces 17*a* and 17*b*. Supporting surfaces 17*a* and 17*b* are adjacent and substantially perpendicular to each other. Supporting surface 17*a* is positioned essentially radial to the axis 16*c* of rotation of locking element 16 and supporting surface 17*b* essentially tangential to the direction D in which locking element 16 rotates. Since the contour of supporting surface 17*b* is essentially an arc of a circle with axis of rotation 16*c* at its center, rotating post 4 and panel 1 will neither be raised nor lowered when locking element 16 moves. As will be particularly evident from FIG. 2, supporting surfaces 17*a* and 17*b* fit precisely into the recess constituted in support 12 by contact surfaces 15*a* and 15*b*. When, accordingly, locking element 16 rotates in the direction indicated by arrow D out of the locking position illustrated in FIG. 2, in which supporting surfaces 17*a* and 17*b* engage the recess, supporting surface 17*b* will initially travel parallel to contact surface 15*b* whereas supporting surface 17*a* will move away from contact surface 15*a* until contact surface 15*b* of support 12 is released. At this instant support 12 can be forced down by the weight of the door against the force of compression spring 14 into the position represented by the dot-and-dash line in FIG. 2 because it is no longer supported by locking element 16, which will now be in the rotated-out position also represented by the dot-and-dash line.

This lowered position of rotating post 4 corresponds to the aforesaid unlocked position of the door.

Locking element 16 can be rotated in two ways: by a piston-and-cylinder drive mechanism 18 or by a Bowden cable 20. Piston-and-cylinder drive mechanism 18 has a piston rod 18 that is connected by a connecting rod 19 with the second lever arm 16*b* of locking element 16. Piston-and-cylinder drive mechanism 18 is attached to frame section 9 by a mount 22 to which is also attached the guide 21 for Bowden cable 20, which also can initiate rotation. The end of Bowden cable 20 is attached to a mounting 26 that is also attached to the second lever arm 16*b* of locking element 16. The other end of Bowden cable 20 is connected in a way that is not illustrated, to a manual operating mechanism in the vehicle. Another similar Bowden cable can be provided when the door is to be unlocked from two separate locations. When piston-and-cylinder drive mechanism 18 or Bowden cable 20 are activated, locking element 16 rotates in the direction indicated by arrow D, disengaging support 12 and lowering rotating post 4.

When the door is to be unlocked in an emergency by activating Bowden cable 20 and the supply of compressed air has not been interrupted, compressed-air cylinder 10, which opens and closes panel 1, must be evacuated to eliminate the pressure it exerts on rotating post 4 for the post to be lowered at all. For this purpose the end of Bowden cable 20 is coupled through an arm 25 with an air-evacuation valve 24 positioned as illustrated in FIG. 5 in the compressed-air system that controls the drive mechanism that opens and closes the door.

As will be evident from FIG. 5, the compressed-air control system includes a source 28 of compressed air that can be connected through a controllable valve 27 with compressed-air cylinder 10 to control the opening and closing motion of piston-and-cylinder drive mechanism 18 in the unlocking direction through a line 30. Compressed-air cylinder 10 can also be connected through a line 31 and air-evacuation valve 24 with the outer atmosphere Compressed-air cylinder 10 is evacuated and the aforesaid procedures for manually unlocking the door initiated when Bowden cable 20 is activated and air-evacuation valve 24 opened.

It will be appreciated that the instant specification and claims are set forth by way of illustration and not limitation, and that various modifications and changes may be made without departing from the spirit and scope of the present invention.

What is claimed is:

1. In a door assembly having a frame, swinging door activated by a rotatable post, with the door being locked and unlocked by raising and lowering the post, and means for securing the door in the locked position including a disk attached to the bottom of the post, a rotatable support for the disk comprising a double-armed lever, means mounting the support below the disk on a stationary section of the frame for displacement into a first position in which the disk rests on a top portion of one of the lever arms, the improvement wherein, the securing means further comprises: means mounting the support to dispose the axis of rotation thereof in a plane that is perpendicular to the direction in which the rotating post is raised and lowered, spring means urging the support into the first position, stop means on the frame, for contacting a bottom portion of the other lever arm of the support urged into the first position by the spring means, a recess in a bottom portion of the one arm of the support, a rotatable locking element comprising a double-armed lever with two support surfaces on a first lever arm, engaging the recess, means mounting the locking element to dispose the axis of rotation thereof parallel to the axis of rotation of the support, the support surfaces of the first arm are adjacent and substantially perpendicular to each other, with one surface extending substantially radially to the axis of rotation of the locking element and the other surface extending substantially, tangentially to the direction of rotation of the locking element, the recess in the support has two adjacent and perpendicular contact surfaces against which the support surfaces of the locking element rest in the first position of the support, and at least one activating mechanism connected to the second lever arm of the locking element to rotate the locking element to disengage two support surfaces of the first arm of the locking element from the recess in the other arm of the support.

2. The door assembly as in claim 1, wherein the other support surface is curved in the shape of an arc of a circle with the axis of rotation of the locking element as the center of curvature.

3. The door assembly as in one of claim 1 through 3, wherein the stop means comprises a stop on the frame and an adjustable height stop is positioned on the bottom of the other lever arm of the support coactive with the stop, on the frame.

4. The door assembly as in claim 1, wherein the at least one activating mechanism comprises a compressed-air activated piston-and-cylinder drive mechanism and a manually activated Bowden cable connected to the second lever arm.

5. The door assembly as in claim 4, further comprising a compressed air cylinder, a control valve through which the cylinder and drive mechanism piston-and-cylinder drive mechanism open and close the door with a source of compressed air and an air-evacuation valve for the compressed-air cylinder activated by the Bowden cable.

* * * * *